US008684064B2

(12) United States Patent
Frede

(10) Patent No.: US 8,684,064 B2
(45) Date of Patent: Apr. 1, 2014

(54) HIGH SPEED ROLLUP DOOR WITH ROLLABLE DOOR LEAF

(75) Inventor: Friedhelm Frede, Lippstadt (DE)

(73) Assignee: Assa Abloy Entrance Systems AB, Landskrona (SE)

( * ) Notice: Subject to any disclaimer, the term of this patent is extended or adjusted under 35 U.S.C. 154(b) by 430 days.

(21) Appl. No.: 12/996,568

(22) PCT Filed: Jun. 6, 2008

(86) PCT No.: PCT/US2008/066139

§ 371 (c)(1),
(2), (4) Date: Jul. 20, 2011

(87) PCT Pub. No.: WO2009/148460

PCT Pub. Date: Dec. 10, 2009

(65) Prior Publication Data

US 2011/0265959 A1 Nov. 3, 2011

(51) Int. Cl.
*E06B 9/17* (2006.01)

(52) U.S. Cl.
USPC ..... 160/133; 160/231.1

(58) Field of Classification Search
USPC ..... 160/135, 229.1, 231.1, 231.2, 133
See application file for complete search history.

(56) References Cited

U.S. PATENT DOCUMENTS

| | | | | |
|---|---|---|---|---|
| 4,234,033 | A * | 11/1980 | Leivenzon et al. | 160/133 |
| 5,095,965 | A * | 3/1992 | Higashiyama | 160/133 |
| 5,307,859 | A | 5/1994 | Kraeutler | |
| 6,065,525 | A * | 5/2000 | Wells | 160/273.1 |
| 6,883,577 | B2 | 4/2005 | Frede | |
| 8,371,357 | B2 * | 2/2013 | Frede | 160/273.1 |
| 2004/0163777 | A1 | 8/2004 | Frede | |
| 2007/0181264 | A1 * | 8/2007 | Frede | 160/133 |
| 2011/0265959 | A1 * | 11/2011 | Frede | 160/133 |

* cited by examiner

*Primary Examiner* — Blair M. Johnson
(74) *Attorney, Agent, or Firm* — Frommer Lawrence & Haug LLP; Ronald R. Santucci

(57) ABSTRACT

An industrial rollup door to selectively cover a doorway opening or to provide industrial guarding is presented. The rollup door comprises door leaf, comprised of lamellae, or panels a flexible strip as a lifting belt for selectively lifting and lowering the door, a continuous dampening profile running along the outer surface of each lamellae near an end, and a rotatable spiral disc to accept the lamellae as the door is lifted and to release the lamellae as the door is lowered.

15 Claims, 8 Drawing Sheets

HIGH SPEED ROLLUP DOOR WITH ROLLABLE DOOR LEAF

This application is a 371 of PCT/US2008/066139 filed on Jun. 6, 2008, published on Dec. 10, 2010 under publication number WO 2009/148460 A.

FIELD OF THE INVENTION

The present invention relates to a rollup door. More particularly, the present invention provides an industrial rollup door with rollable door leaf comprised of lamellae or panels, for covering the door opening. Even more particularly, the present invention provides a rotatable shaft to accept a rollup industrial door leaf in successive layers in a compact way at high speed with a low level of noise and wear.

BACKGROUND OF THE INVENTION

Industrial facilities, such as factories, warehouses, garages, and the like use rollup doors to cover doorways or to guard machinery in order to provide security, as well as protection from debris, and unwanted climatic variations. Typically, an industrial rollup door with rollable door leaf includes rail frame components on the left and right sides of the doorway and a door leaf comprised of a plurality of lamellae or panels adapted to travel within the left and right frame components. In one particular type of door, a lifting component is attached to the door and to a rotary shaft mounted above the doorway, when the door is made for a vertical installation. To operate the door, the rotary shaft is activated in one direction to roll the door leaf up onto the shaft to open the doorway. Rotation in the opposite direction unrolls the door leaf to close the doorway. Vertical operation is typical, but angled operation is also possible.

Typical industrial rollup doors had a number of drawbacks in their operation. It was recognized, for instance, that substantially rigid flat lamellae had desirable characteristics, such as providing a secure barrier, but could not be rolled up in a compact fashion. The initial layer of lamellae would not conform to the curvature of the rotary shaft because of the rigidity of the lamellae. Because the leaf would not conform to the curvature of the rotatable shaft, the rolled up door leaf would assume an asymmetrical configuration with significant gaps between the leaf and the shaft. The rigid leaf assumed a tangential orientation with the shaft. Additional layers could not conform to the underlying layers, creating additional gaps. The retracted door in an end view when wound on the shaft, assumed an asymmetric polygonal shape, rather than a closely packed, symmetric and smooth circular shape. Furthermore, additional layers wound on the shaft rested upon the inadequately supported prior layers, subjecting the prior layers to significant bending loads and leading to damage.

Related drawbacks include the noise and wear resulting from contact between subsequent layers of the lamellae. Layers of lamellae coming in contact with each other as the door is operated, either up or down, generate undesirable noise. In addition to noise, contact between lamellae created wear on the contacting surfaces which is manifested by aesthetically objectionable marks. Continued wear could result in damage to the integrity of the door.

One innovation that addressed the noise and damage concerns is presented in U.S. Pat. No. 6,883,577 ("the '577 patent"). The '577 patent provides door leaf or lamellae of increasing width from the top of the doorway to the bottom with guidance provided by side rails or frames located at the edges of the doorway. A rotating shaft is fitted with spiral surfaces of increasing diameter from a central portion of the shaft toward the outward ends of the shaft. Overall the outer surface shape is that of a stepped cone. As the shaft rotates to lift the door, the narrower door leaf is taken up first by the inwardly located conical surfaces. Subsequently wider door leaf is taken up by the appropriately located conical surfaces of greater diameter located closer to the ends of the shaft. Dampening material is located on the rotating surfaces to attenuate noise generated by contact between the round surfaces and the lamellae. The conical surfaces are configured to maintain spacing between successive layers of lamellae, thereby preventing noise and damage caused by contact.

The prior art cited effectively addressed the noise and damage issues but has other characteristics for which improvement may be desired. In order to properly guide and control the left and right ends of the rollup door, the side frames provided must be sized to guide the narrowest lamella as well as the widest. To accommodate both the narrowest and the widest lamellae, the side frame either was tapered from a deeper rail at the top of the doorway to a less deep shape at the bottom, or the rail was made uniformly deep enough to guide the narrowest lamellae. Such side rails are somewhat expensive to manufacture or somewhat decrease the available doorway width, or both. Additionally, the complexity of the rotating shaft increased to a certain degree the production cost and weight of the shaft, and increased the size of the required motor to drive the shaft. Further, the lamellae of the prior art door are, by necessity, of various lengths. This requires an inventory of various lengths of lamellae for replacement purposes.

U.S. Pat. No. 5,307,859 ("the '859 patent") teaches an alternate industrial rollup door in which a doorway is covered by a flexible transparent sheet or curtain suitable for winding onto a shaft to open a doorway or unwinding from the shaft to block the doorway. Horizontal stiffening members are provided at various vertical locations to provide stability. According to the invention, two strips of sufficient thickness are formed on the curtain so that each of them is rolled onto itself while the curtain is being raised. When the curtain is rolled up, contact between front and back faces of the curtain is limited, and no contact occurs in the vicinity of the strips. The separation preserves the transparency of the curtain over time. Although transparency may be desirable in certain applications, flexible sheet or curtain doors do not provide significant resistance to breaching.

The present invention addresses the shortcomings of the prior art by providing a rollup door that can be wound up in a compact way at a high speed, generating less noise and less wear, while also protecting the lamellae from damage during operation.

SUMMARY OF THE INVENTION

It is therefore a principle object of the instant invention to provide an industrial rollup door to selectively cover a doorway opening or to provide industrial guarding, the rollup door comprises a door leaf comprising lamellae or panels, at least two flexible strips as lifting belts for selectively lifting and lowering the door, and a rotatable shaft fitted with a spiral disc to accept the lamellae as the door is lifted and to release the lamellae as the door is lowered, and a dampening profile running along the outer surface of each lamellae at each end.

It is a further aspect of the present invention to provide an industrial rollup door comprising end pieces fitted to the ends of the lamellae and configured to engage at least one lifting belt at each widthwise edge of the door. Advantageously, the end pieces for one or more lamellae may contain wind anchors to resist wind forces.

It is a further aspect of the present invention to provide an industrial rollup door in which edges of adjacent lamellae are configured to at least partially engage in a pivoting fashion.

It is a further aspect of the present invention to provide an industrial rollup door in which at least one edge of adjacent lamellae is at least partially configured to accept a resilient member. The resilient member can be a dampening device to cushion contact between lamellae, thereby dampening noise and preventing damage, or a resilient hinge to at least partially seal and flexibly join adjacent lamellae.

A further embodiment of the instant invention provides an industrial rollup door comprised of elongate lamellae having, in general, a flattened arcuate C-shape cross section, curved to have a concave and a convex face, with the concave surface facing inward, towards the rotatable shaft. The flattened C-shape may be a smooth contour or may be made up of a plurality of curved or straight segments joined to form a flattened C-shape. The lamellae may be solid or may have window-like openings extending there through, as for ventilation or visibility. The openings may be covered on one or both sides with transparent or translucent materials to limit ventilation or visibility.

The instant invention provides an industrial rollup door comprised of elongate lamellae having, in general, the flattened arcuate C-shape cross section in which the cross section is selected such that when rolled up provides for a compacted configuration.

A further embodiment of the instant invention provides an industrial rollup door comprised of elongate lamellae fabricated from substantially rigid materials such as metal, wood, or plastic. The lamellae may be transparent or translucent.

A further embodiment of the instant invention provides an industrial rollup door comprised of elongate lamellae of equal, or substantially equal, length.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
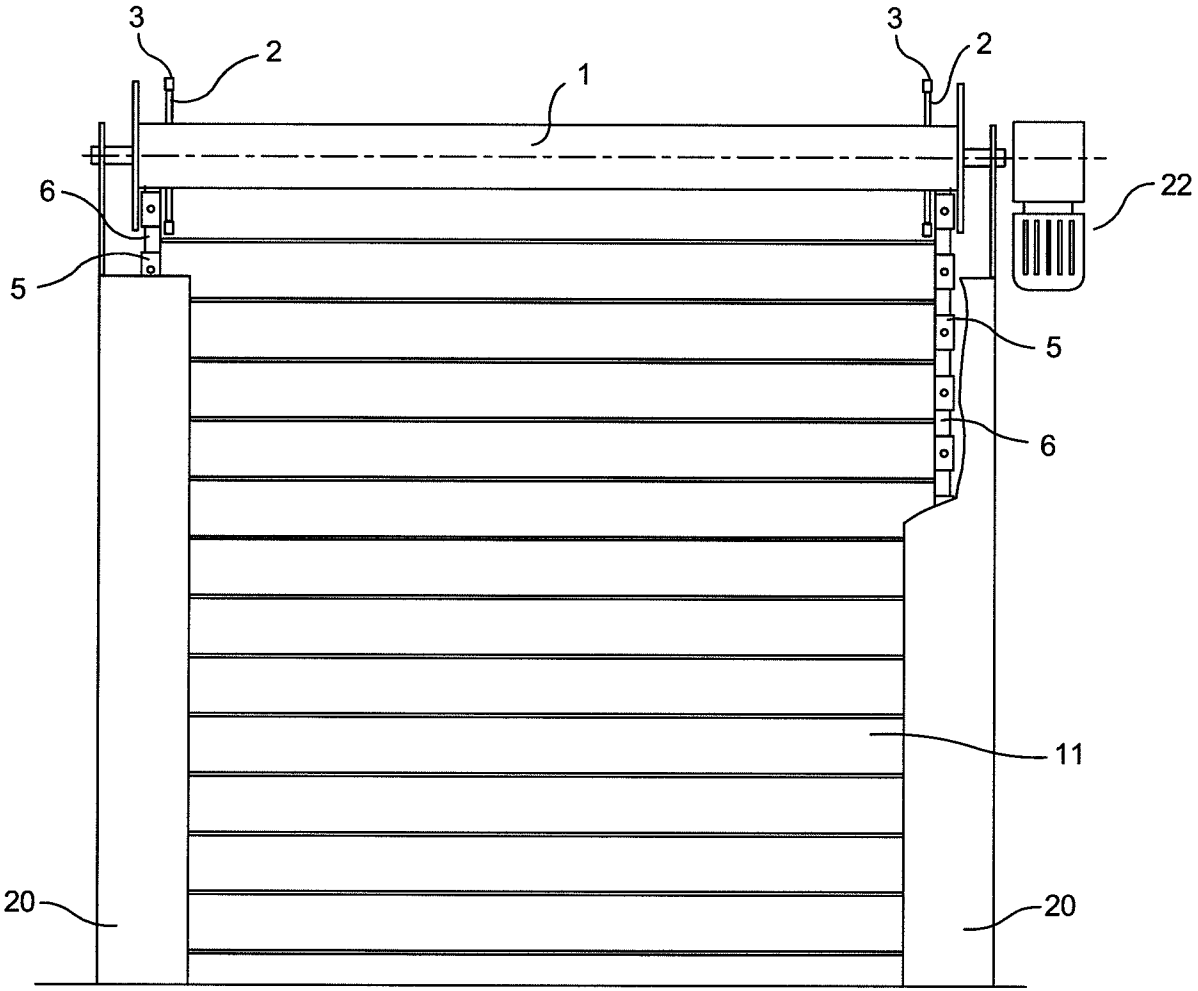
FIG. 1 is a partial front view of one example of the rollup door of the present invention in which the door is closed. For clarity, the lamellae are not engaged with the spiral disc.

The instant invention will now be described more fully hereinafter with reference to the accompanying drawings in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

In the following description, like reference characters designate like or corresponding parts throughout the figures. Further, the industrial rollup door will be described as selectively blocking a doorway. This recitation is for convenience only. It would be understood by one skilled in the art that such a door is suitable for many applications, including, but not limited to, interior doorway covering, exterior doorway covering, or to provide a secure perimeter around dangerous areas, for instance, around machinery.

The instant invention relates to a rollup door for selectively blocking or opening a doorway or door opening, or to provide a secure perimeter or guarding. The door is comprised of door leaf comprised of lamellae or panels, arranged in a generally horizontal fashion to span the width of a doorway with the ends of the lamellae having endpieces configured to travel in vertical side rails or guides arranged on either side of the doorway. The door is configured for vertical movement to open or close the doorway, but angled operation is also possible. Each lamellae end portion is configured to accept an end piece. Each endpiece is removably attached to a lifting belt such that each lamella is supported by it ends, through the end piece, independent from other lamellae. Thus individual lamellae may be removed and replaced in a partially closed door without removing or disassembling the entire door structure.

An open doorway is achieved by withdrawing the door from the opening by rolling the lamellae onto a rotatable shaft generally located above the doorway. Lamellae are wound onto the shaft in a smooth and efficient fashion with few gaps or discontinuities. Noise generated by contact between the lamellae is attenuated, or dampened, by the placement of a dampening profile on at least one surface of the lamellae to provide a gap between adjacent layers of lamellae.

A first embodiment of the rollup door according to the present invention is described with reference to FIG. 1, in which a partial view of the front of a door according to one embodiment of the instant invention is shown. As illustrated, the plurality of lamellae or panels 11 is shown all below the shaft to provide a closure of the opening in the doorway. For clarity, no lamellae are shown on the spiral disc 2 which is affixed to rotatable shaft 1. As can be seen in the figure, side rails 20, provided on either widthwise side of the doorway, define the width of the doorway and are configured to accept end pieces 5 within a slot or track. A partial cutaway view shows the end pieces 5 and the lifting belt 6 unobstructed by the side rail at one edge of the door. A second edge of the door is similarly configured with end pieces 5 and lifting belt 6 as shown above the side rail. A drive system 22 provides rotational force or torque to the shaft in one direction to raise the door and in a second direction to lower the door.

Figure 2:
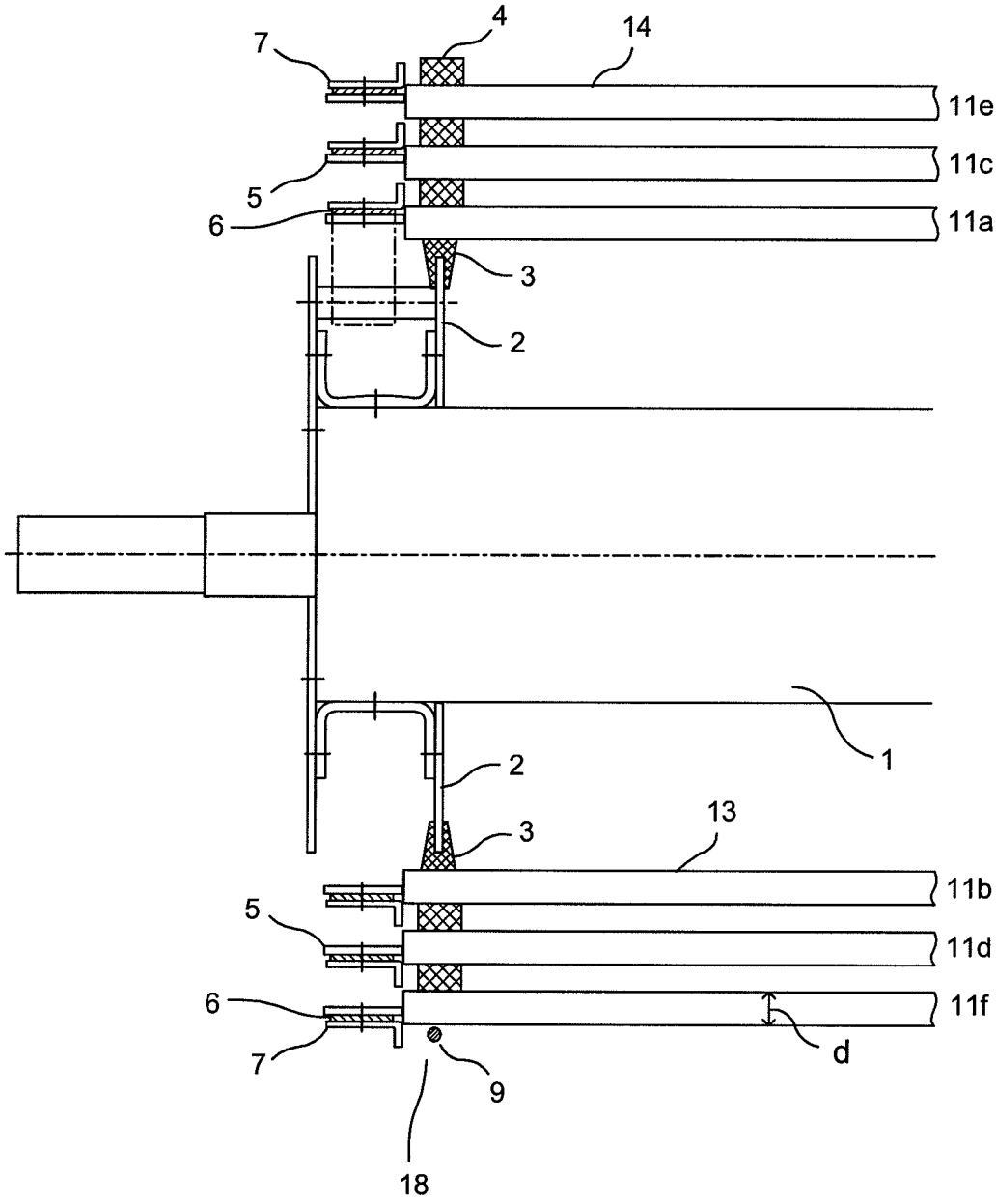
FIG. 2 is a partial cross sectional view taken through the shaft axis of a door according to one embodiment of the instant invention in a fully rolled up or retracted position illustrating one end of the rolled up door (the other end is a mirror image thereof)
Figure 3:
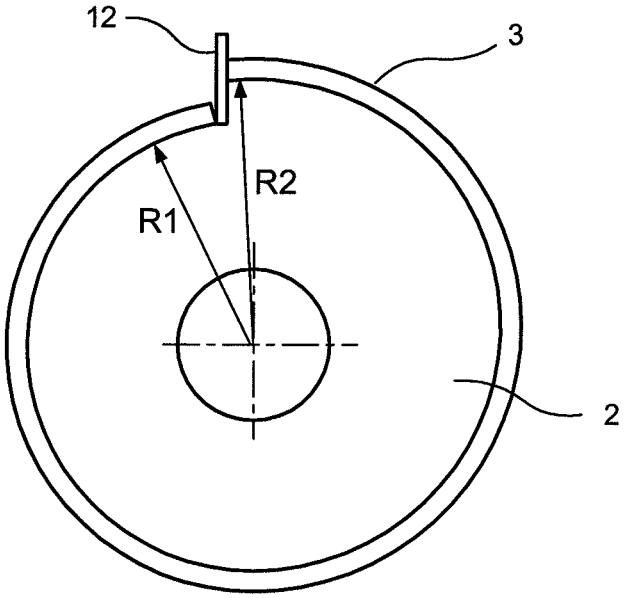
FIG. 3 is an end view of a spiral disc according to one embodiment of the instant invention.

FIG. 2 is a partial cross sectional view taken through the axis of rotation of rotatable shaft 1, illustrating a fully retracted door according to one embodiment of the present invention, in which elongate lamellae 11*a*-11*f* of depth d are shown wound as successive layers upon spiral disc 2 on shaft 1. As can be seen in FIG. 3, spiral disc 2 has an outer diameter which smoothly transitions from R1 to R2 over a rotation of approximately 360 degrees. Dampening profile 3 is attached to the outer circumference of disc 2.

Figure 4A:
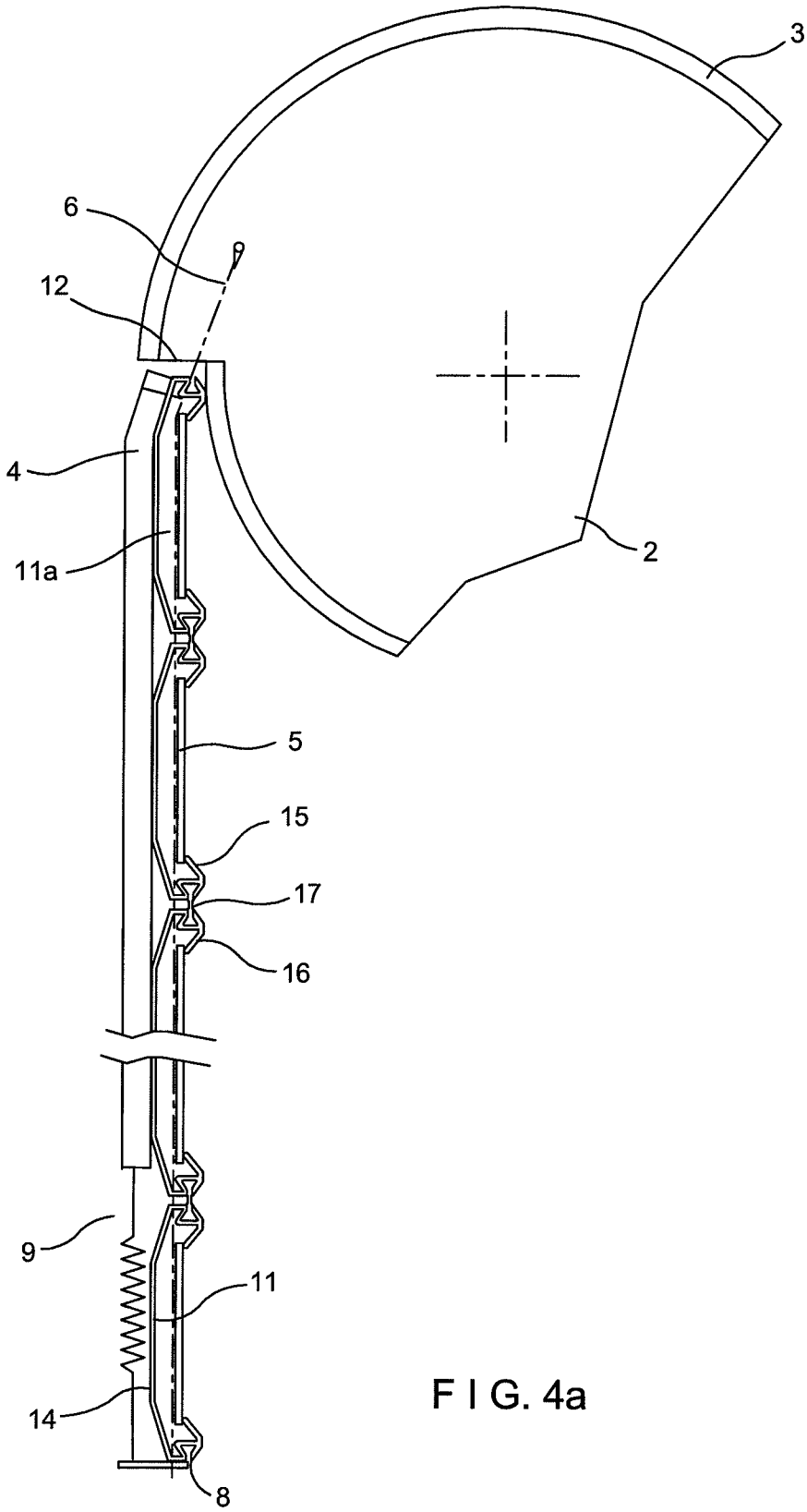
FIG. 4*a* is a cross sectional end view of a portion of a door according to one embodiment of the instant invention with a generally configured lamellae shown in a closed position.
Figure 4B:
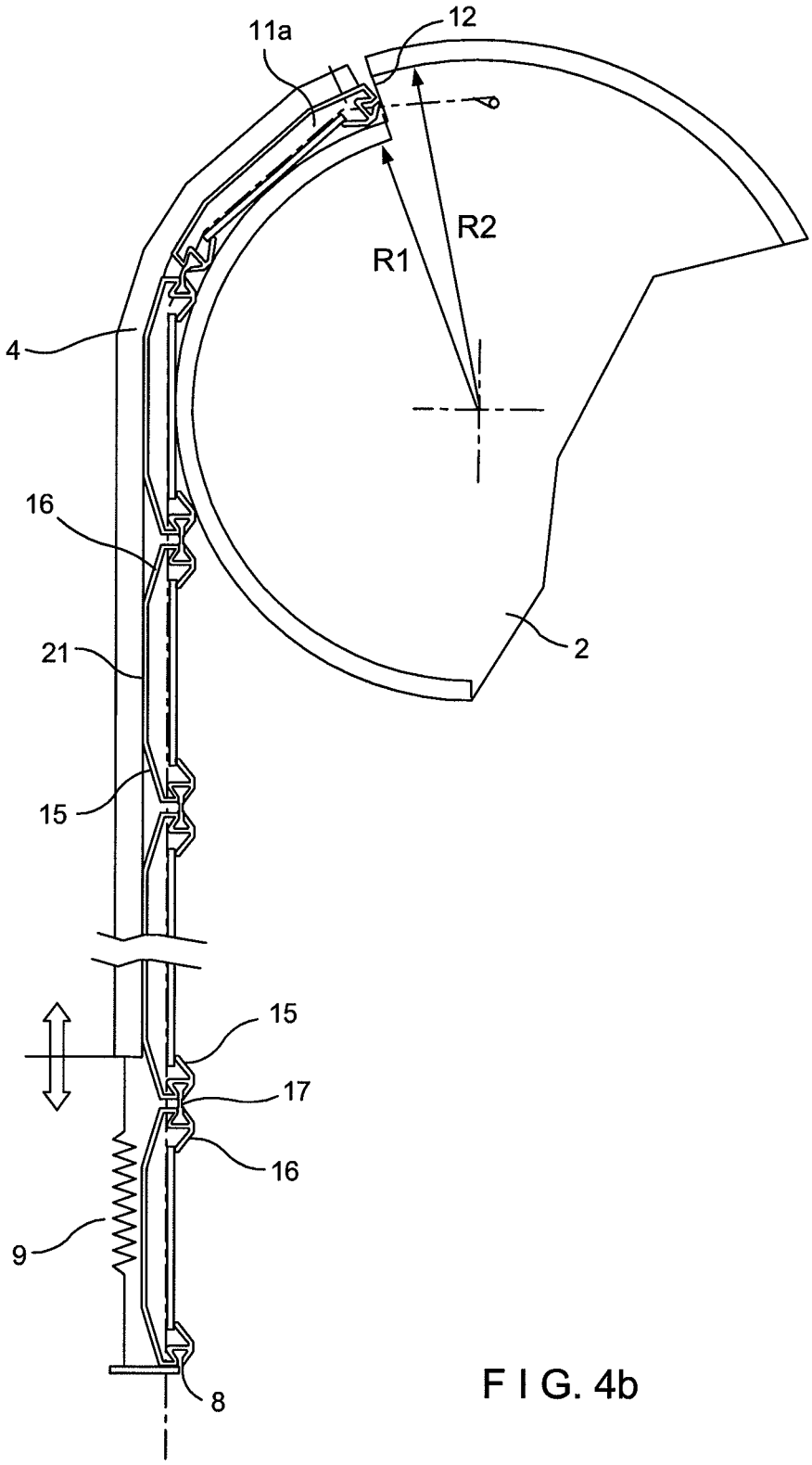
FIG. 4*b* is a cross sectional end view of a portion of a door according to one embodiment of the instant invention with two generally configured lamellae shown rolled up on the disc.
Figure 4C:
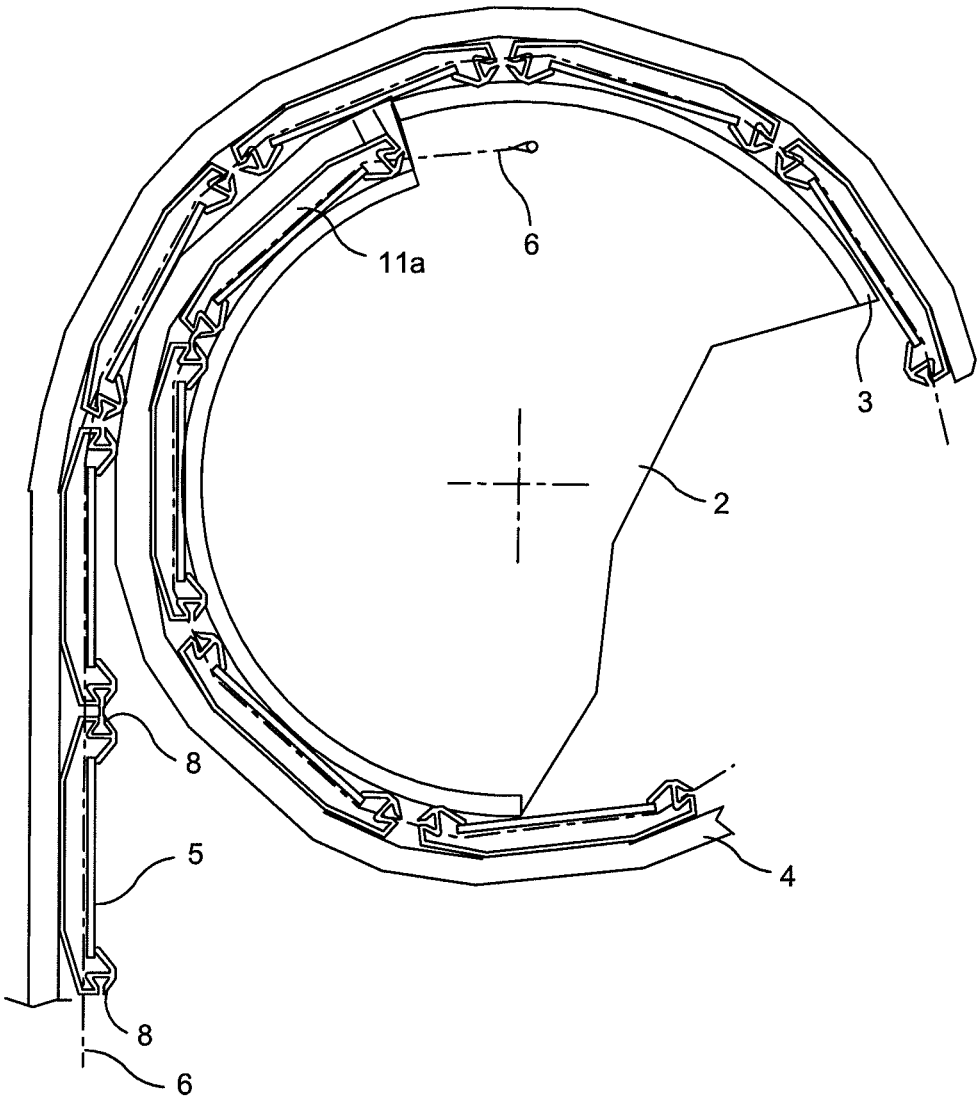
FIG. 4*c* is a cross sectional end view of a portion of a door according to one embodiment of the instant invention with several generally configured lamellae shown rolled up on the disc creating a second layer on top of the first layer.
Figure 5A:
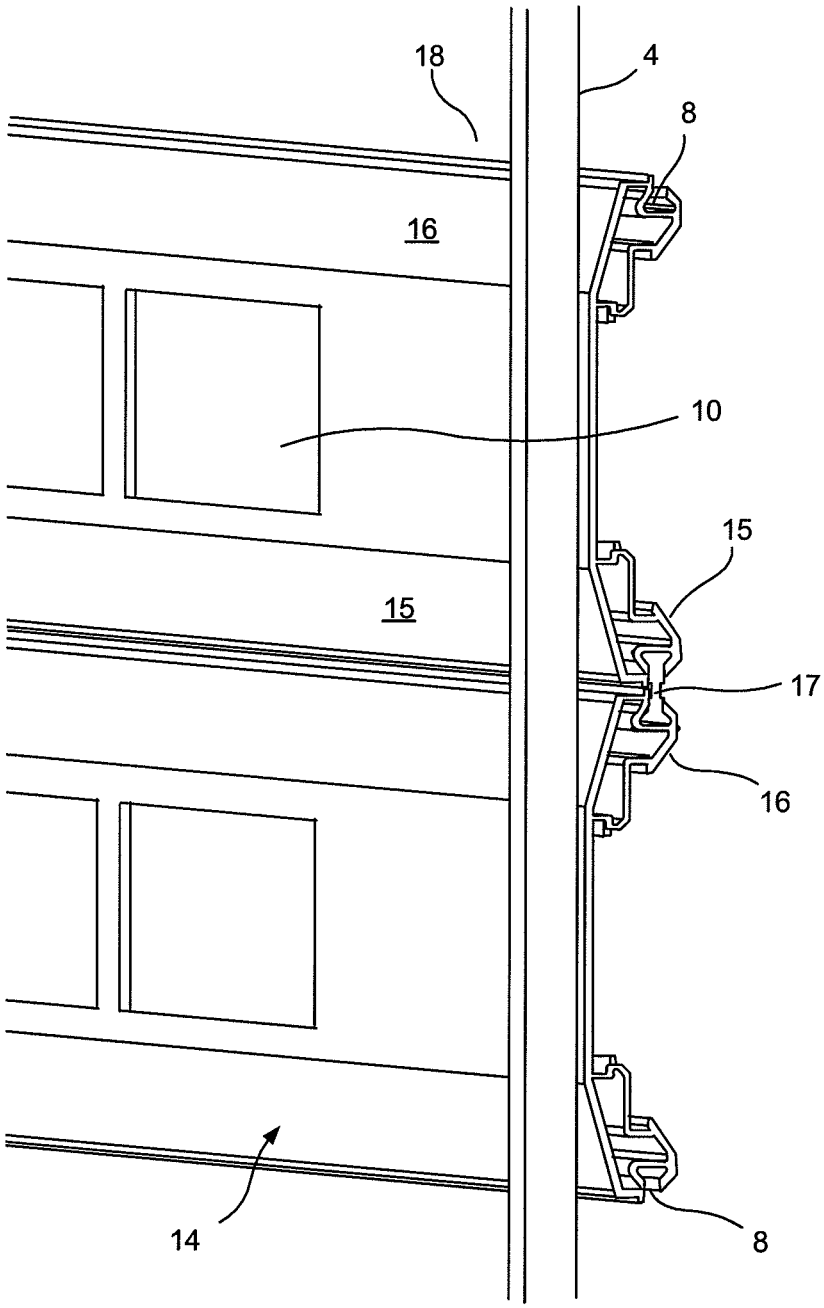
FIG. 5*a* is a perspective view of a portion of a door according to one embodiment of the instant invention.
Figure 5B:
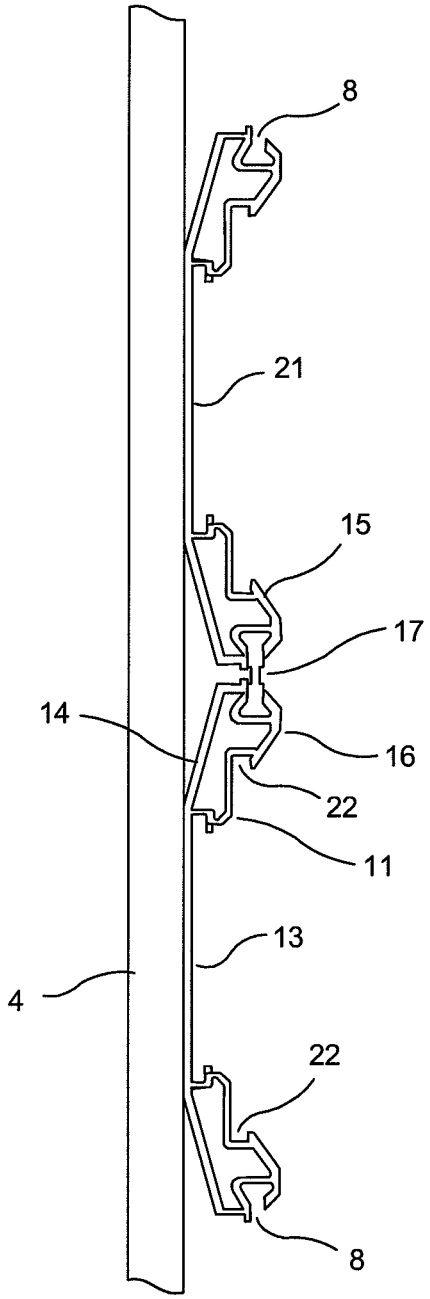
FIG. 5*b* is FIG. 5*a* seen as a cross sectional view.

Lamella 11*a*, proximate to shaft 1 and typically the top lamella 11 when the door is fully open, rests on spiral disc 2 adjacent to surface 12 as seen in FIG. 4*a*. Lamella 11*a* is fixed to lifting belt 6, which in turn is anchored to spiral disc 2, as shown in FIGS. 4*a* and 4*b* and described in more detail below. Note the cross sectional view of the lamellae shown in FIGS. 4*a*-4*c* is a general illustration. The complete illustration is shown in FIGS. 5*a*-5*b* without the end piece.

As further shown in FIGS. 4*a* and 4*b*, dampening profile 4 is attached to the outside surface of topmost lamella, lamella 11*a*, removably fastened in any manner known in the art, including, but not limited to, mechanical means or adhesives. Dampening profile 4 rests at the end portion 18 on all successive lamellae 11 as a continuous length on the outer surface 14 when the door is in its lowered position, as show in FIGS. 4*a* and 5*a*. The dampening profile 4 may be comprised of connected segments to form a continuous length or may be one continuous length. Lamellae 11*f*, as shown in FIG. 2, is illustrated without dampening profile 4 on the outer surfaces 14. This is a natural result of the circumferential distance of the wound door from the first lamella 11*a* to the final lamella 11*f* exceeding the linear distance between the same two lamellae when unwound, i.e. when the doorway is fully blocked by the door. As the door rolls up, the dampening profile 4 runs on the outside surface 14 of the lamellae 11, and thereby travels a longer path than the linear distance, and does not reach to the end lamella 11*f* when the door is fully rolled. To allow for the relative movement between the dampening profile 4 and the lamellae 11 of the door, and to keep the dampening profile 4 in place, a compensation belt or member 9 may be used to attach the lower end of the dampening profile 4 to the bottommost lamellae of the door leaf as shown in FIGS. 4*a* and 4*b*. The compensation belt is a resilient member, such as a spring or a rubber string, extendable between a first position and a second position that compensates for the difference between the linear length of the door leaf when unwound and the circumferential distance when the door is wound.

As illustrated in FIGS. 3 and 4*b*, spiral disc radius R2 exceeds R1 by a dimension approximately equal to the sum of the thickness of the dampening profile 3 on the spiral disc 2, the thickness of dampening profile 4 on the lamellae, and the thickness, t, of one lamella 11. In this configuration, as shown in FIG. 4*c*, the first layer of lamellae 11 on the disc 2 follows a smooth curve, and each successive layer of lamellae lies smoothly atop the dampening profile 4 of the preceding layer with minimal discontinuities. As best shown in FIG. 5*b*, lamellae 11 are generally a flattened arcuate "C" shape in cross section, with generally concave inside surface 13 and a convex outer surface 14. The lamellae cross section is chosen to substantially conform to the disc 2, as well as to allow successive layers of lamellae 11 wound onto the disc 2 to present a smooth wound surface and a compact rolled up door leaf.

The shape of the lamella is not trivial and is important for the lamellar stiffness, rigidity, and aesthetics as well as for providing compactness of the diameter of the rolled up door leaf. In this regard, a lamella comprises a flat center portion 21 and bottom portion 15 and top portion 16 which are angled away from the center portion 21 and which provides a slot or channel 22.

A geometric relationship exists between the height of the door opening, the configuration of the spiral disc, and the cross section and number of lamellae. As presented in the drawings, for example, the doorway height top be covered is 3 meters (m), and the lamella height is 100 millimeters (mm). The configuration of the spiral disc 2 accepts 8.5 lamellae 11 in the layer of the first turn. Each layer creates a greater diameter for successive layers to wind up onto, resulting in more lamellae on each layer. As configured on the drawings, a fully wound up door will require 3 turns of the spiral disc.

Figure 6:
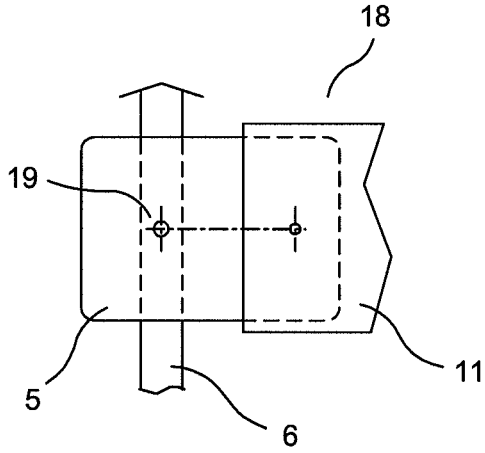
FIG. 6 is a front view of the end portion of a lamella according to one embodiment of the instant invention.

End pieces 5 are fixed at a first end to each end portion 18 of lamellae 11 as shown in FIGS. 1 and 2 and known in the art. The second end of the end piece 5 is securely and removably attached to an intermediate portion of a lifting belt 6 as shown in FIG. 6. The attachment means 19 can be any means known to the art, for example threaded fasteners, rivets, removable staples, or the like, capable of providing secure attachment of the end piece 5 to the lifting belt 6 and capable of removal for replacement of damaged or worn components. FIG. 6 shows one attachment means 19 for illustration purposes only. It would be clear to one skilled in the art to use one or more of said means as is appropriate.

As can generally be seen in FIGS. 4*a*, 4*b* and 4*c*, the lifting belt 6 is fixed at one end to the spiral disc 2, or to mechanical components or links attached to the disc 2, so the lifting belt will be displaced substantially the same distance as the disc 2 surface as the disc rotates in one of two directions. In one direction, the lifting belt 6 with end pieces 5 will be hoisted and rolled up, causing the lamellae to be wound onto the disc 2, opening the doorway. In a second direction of rotation, the belt 6 will unwind from its rolled up position, releasing the lamellae 11 to cover the doorway opening. In the view presented in FIG. 4*a*, a clockwise rotation would wind the lamellae 11 onto spiral disc 2, opening the doorway, and a counterclockwise rotation would lower the lamellae 11, closing the doorway.

Because the lamellae 11 are secured to the lifting belts 6 through the end pieces 5, the position of one lamella to another is determined by the lifting belts 6. No mechanical linkage between adjacent lamellae is necessary, thus each lamella supports only its own weight. Additionally, because the lamellae 11 are each individually supported by end pieces 5, damaged or worn lamellae 11 can easily be removed from the door by separating the attachment means 19 between the end piece 5 and lifting belt 6. Individual lamellae 11 can be removed from the door without disassembly of the bottom lamella of the door leaf. In certain situations, a door may be used with one or more lamellae 11 missing without compromising the operation of the door.

In one exemplary embodiment of the instant invention, at least part of adjacent lamellae bottom portions 15 and top portions 16 are configured to pivotally engage. Engaging bottom and top portions 15, 16 may provide added security to prevent a breach of the door by resisting forces perpendicular to the outside 14 or inside 13 surface of the door. In a further exemplary embodiment, at least one of the bottom and top portions 15, 16 may be configured to accept a resilient insert to avoid adjacent portions of lamellae 11 from contacting each other in use, therefore further reducing noise.

FIGS. 4*a*, 4*b*, 5*a*, and 5*b* illustrate exemplary embodiments in which bottom portion 15 and top portion 16 of adjacent lamellae 11 may be configured with receiving channels 8 to accept a resilient hinge member 17 by any method known in the art. Advantageously, resilient hinge member 17 may be sufficiently flexible to allow the lamellae to flex during opening and closing of the door. During insertion, the resilient hinge 17 can be snapped, pushed or pulled into place, rather than having to slide the resilient hinge 17 into the respective receiving channels. The resilient hinge 17 may have different flexibility or softness in the center portion and the top and bottom portion that shall be put into the receiving channels 8. Due to the shape of the channels, there may be a need for harder top and bottom material so the member is securely received in the receiving channels 8 during the movement of the door leaf. Replacement therefore does not require removing the lamellae or detaching the door from the side guides. Furthermore, such flexible hinges have an advantage over interlocking lamellae in that if they are damaged, they can be replaced rather than having to replace the entire lamella. The hinge member 17 may be continuous to provide sealing between adjacent lamellae. The hinge member 17 may provide sealing to limit the transmission of noise, wind, vapors or the like. Another embodiment may have interrupted hinge members 17 along at least part of the adjacent bottom and top portions 15, 16 to prevent contact between adjacent lamellae 11, thus reducing noise. The hinge member 17 provides at least a partial flexible link between the bottom and top portions 15, 16 of adjacent lamellae 11. The configuration of bottom and top portions 15, 16 of the lamellae and the resilient hinge member 17 illustrated are just two possible complementary configurations. Many other suitable configurations would be known to one skilled in the art.

The lamellae inner and outer surfaces 13, 14 may be solid, as illustrated in FIG. 1, or may have one or more openings 10 through the inner and outer surfaces 13, 14 to provide ventilation or visibility as shown in FIG. 5*a*. In one embodiment, a transparent material (not shown) may be placed over the openings 10 to provide illumination and visibility while reducing ventilation. In a further embodiment, lamellae 11 may be made from a transparent material for maximum light transmission or a tinted or treated clear material. Alternate embodiments include lamellae 11 fabricated from substantially rigid materials including, but not limited to, wood, metal, or plastic. A further alternate embodiment may include lamellae 11 fabricated from resilient or flexible materials, clear or opaque, as the application requires.

As successive layers of lamellae 11 are wound up by the rotatable shaft 1 onto spiral disc 2, support is provided by prior wound layers as seen in FIGS. 2 and 4*c*. Lamellae 11 of successive layers are spaced apart by the dampening profile 4. As shown in FIG. 2, the end portions 18 of the lamellae 11 may align with one another at the end of shaft 1. The opposite end of rotatable shaft 1 is a mirror image of that shown, with the end portions 18 of the lamellae 11 also aligning. With equal length lamellae 11, the side rails 20 can be kept to a single depth determined by the amount of overlap desired between the side rails 20 and the end pieces 5. As shown in FIG. 1, the side rails may also partially overlap the end portion 18 of the lamellae 11 as may be required. Maintaining a single length lamella requires fewer replacement parts, lessening manufacturing costs. As shown in the partial cutaway section of FIG. 1, the end pieces 5 extend into a track provided in the side rails 20 on each side of the doorway. The side rails 20 may be sufficiently deep to accept the end piece 5 and the lifting belt 6, increasing security and safety. On the rear side of the door, the dampening profiles 4 run vertically along each edge portion of the lamella 18, not shown. However the dampening profile 4 shall also preferably be covered within the side rails 20. Other applications may require only that the end pieces 5 be held within the side rails. Further applications may require greater overlap between the side rails and the door. Yet other applications my require one or more wind anchors 7 on each edge of the lamellae, as shown in FIG. 2, to resist displacement of the door due to high winds, as is known in the art.

Although a preferred embodiment of the present invention and modifications thereof have been described in detail herein, it is to be understood that this invention is not limited to this precise embodiment and variations and may be effected by one skilled in the art without departing from the spirit and scope of the invention as defined by the appended claims.

What is claimed is:

1. An industrial rollup door for closing or opening a doorway fitted with side rails and a cross piece spanning the doorway width proximate to the top of the doorway comprising:

a door leaf comprising a plurality of elongated rigid lamellae, each lamella having a left end portion, a right end portion, a top portion, a bottom portion, an inner surface and an outer surface;

at least one flexible lifting belt on each end portion of the lamellae;

end pieces fitted to the end portions of each lamella to engage the lifting belt at an intermediate portion;

a continuous, flexible dampening profile strip fixed to each end portion of a top lamella and positioned on the outer surface of the end portions of a plurality of lamellae; and a rotatable shaft fitted with a spiral disc profile including a dampening profile attached to the outer circumference, the spiral disc profile adapted to accept the lamellae in successive layers as the shaft rotates in a first direction, and to release the lamellae as the shaft rotates in a second direction; wherein the flexible dampening profile strip is secured to the bottom of the door leaf by a compensating member extendable between a first position and a second position.

2. An industrial rollup door as claimed in claim 1 in which at least parts of adjacent bottom portions and top portions of the lamellae are configured to pivotally engage each other.

3. An industrial rollup door as claimed in claim 1 in which at least parts of at least one of adjacent bottom portions and top portions are configured to accept a resilient member.

4. An industrial rollup door as claimed in claim 1 in which at least parts of adjacent bottom portions and top portions are configured to accept a resilient hinge member to flexibly join the lamellae.

5. An industrial rollup door as claimed in claim 1 wherein the lamellae are generally a flattened arcuate "C" shape in cross section.

6. An industrial rollup door as claimed in claim 1 wherein the lamellae comprise a plurality of openings through the front surface and the back surface.

7. The industrial rollup door as claimed in claim 6 wherein the openings are covered on at least one side with a transparent material.

8. An industrial rollup door as claimed in claim 1 wherein the lamellae are fabricated from substantially rigid materials including, but not limited to, wood, metal, or plastic.

9. An industrial rollup door as claimed in claim 1 wherein the lamellae are uniform in length.

10. An industrial rollup door as claimed in claim 1 wherein one or more lamellae, or portions thereof, are transparent.

11. An industrial rollup door as claimed in claim 1 wherein one or more of the lamellae include endpieces with wind anchors.

12. An industrial rollup door as claimed in claim 1 in which the compensating member is an elastic member.

13. An industrial rollup door as claimed in claim 1 in which the spiral profile and lamellae are configured to closely engage upon shaft rotation in a first direction.

14. An industrial rollup door as claimed in claim 1 in which the lamellae are configured to closely engage in successive layers upon shaft rotation in a first direction.

15. An industrial rollup door as claimed in claim 12, wherein the elastic member is a spring.

* * * * *